United States Patent [19]

Mosser, III

[11] 4,317,006

[45] Feb. 23, 1982

[54] LOAD COIL

[75] Inventor: Benjamin H. Mosser, III, Middletown, Pa.

[73] Assignee: AMP Incorporated, Harrisburg, Pa.

[21] Appl. No.: 157,743

[22] Filed: Jun. 9, 1980

[51] Int. Cl.[3] ..... H01F 17/08; H01F 5/04; H01F 41/10

[52] U.S. Cl. ..... 178/46; 336/90; 336/192

[58] Field of Search ..... 178/45-46; 336/65-68, 90, 96, 105, 107, 192, 209; 174/52 R, 52 F, 138 F

[56] References Cited

U.S. PATENT DOCUMENTS

| | | | |
|---|---|---|---|
| 3,838,213 | 9/1974 | Georgopulos et al. | 178/46 |
| 3,865,980 | 2/1975 | Moser et al. | 178/46 |
| 3,952,906 | 4/1976 | Georgopulos et al. | 178/46 X |
| 3,988,707 | 10/1976 | Moser et al. | 178/46 X |
| 4,267,404 | 5/1981 | Rohde | 178/46 |

OTHER PUBLICATIONS

"Radio's Master", United Catalog Publishers, Inc., New York, 1953; pp. F-18-F-19 & Title p.

*Primary Examiner*—Marvin L. Nussbaum
*Attorney, Agent, or Firm*—Frederick W. Raring

[57] ABSTRACT

Coil cartridge intended for use in a load coil assembly comprises a cylinder housing having a stack of toroidal coils therein. The coil wires extend through a seam in the coil housing to terminal housings mounted on the surface of the coil housing. The terminal housings contain terminals to which the coil wires are connected by wire-in-slot connections and the terminals also have slots dimensioned to receive lead wires. The coil housing is a hinged member consisting of two semi-cylindrical parts so that the coils having the terminal housings associated therewith can be placed in the coil housing when it is open. When the coil housing is closed, interengaging means on the coil housing and on the terminal housings latch the coil housing in its closed condition.

8 Claims, 6 Drawing Figures

LOAD COIL

FIELD OF THE INVENTION

This invention relates to coil cartridges containing a plurality of individual toroidal coils and which are used in load coil assemblies of the type employed for telephone cables.

BACKGROUND OF THE INVENTION

It is common practice in the telephone industry to provide at intervals on a telephone cable, a load coil assembly which consists of a plurality of individual toroidal coils with the wires of each coil connected in series with the wires of the telephone cable. A variety of methods are used to produce load coils, that is, to mount them in a suitable casing and to provide the connections between the individual toroidal coils and the lead wires which extend to the multi-conductor telephone cable.

One widely used packaging system for load coils comprises a load coil assembly which contains a plurality of identical load coil cartridges. Each cartridge contains a plurality of load coils and terminal means are provided on the cartridge for connecting the coil wires contained in the cartridge to the lead wires. Heretofor, a simple solder tab type terminal has been used which, while effective, involves time-consuming and inconvenient assembly and production processes, so that a relatively high cost of the cartridge results. It would be desirable to provide wire-in-slot type terminations and connections for both the coil wires and the lead wires of such coil cartridges and to otherwise reduce the time required to produce such cartridges. The present invention is directed to the achievement of an improved coil cartridge having wire-in-slot type terminating means and to improved methods of producing coil cartridges for load coil assemblies.

In accordance with the invention, the coil cartridge housing is produced as a hinged cylindrical member which when open is adapted to receive a stack of individual toroidal coils. The invention also requires the use of terminal housings having terminal-receiving cavities for terminals which are adapted to establish contact with both coil wires and lead wires. The terminal housings and the coil housing have interengaging means thereon, such that when coils are placed in the coil housing and the coil housing is closed, the terminal housings can be assembled to the coil housings and the interengaging means will function to maintain the coil housing in its closed condition. Thereafter, the lead wires can be connected to the terminals by merely inserting the lead wires into the terminal-receiving cavities and into the terminals in the cavities, the same terminals having previously been connected to the coil wires.

PRACTICE OF THE INVENTION

Figure 1:
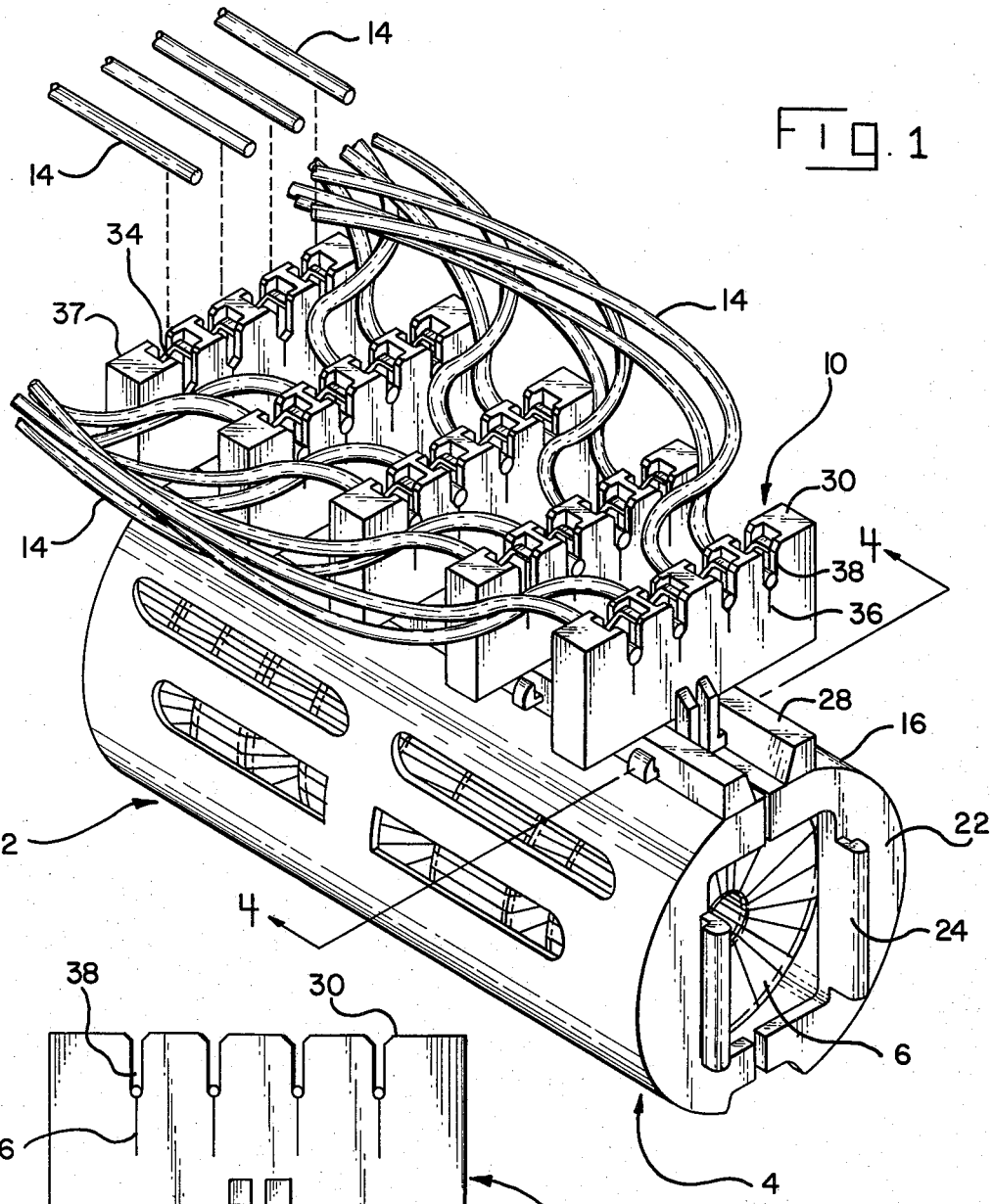
FIG. 1 is a perspective view of a coil cartridge in accordance with the invention, showing the connections between the lead wires and the coil wires.
Figure 4:
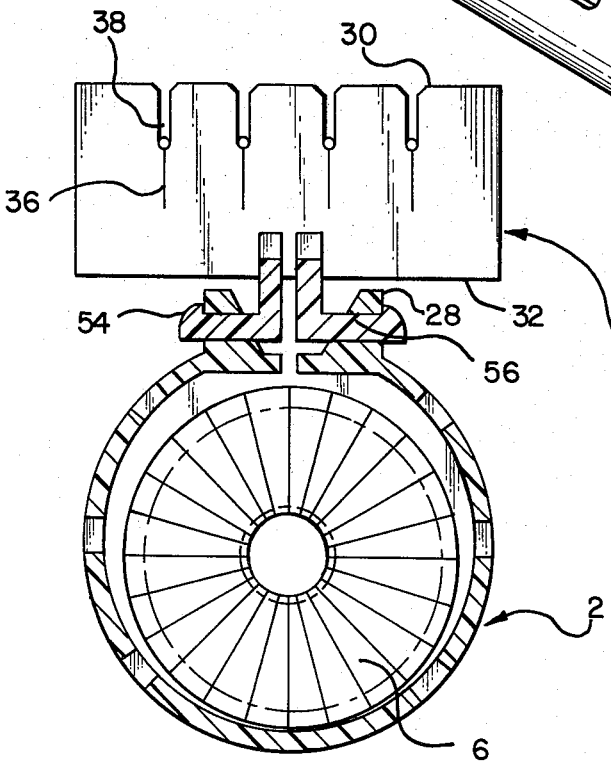
FIG. 4 is a view taken along the lines 4—4 of FIG. 1.
Figure 2:
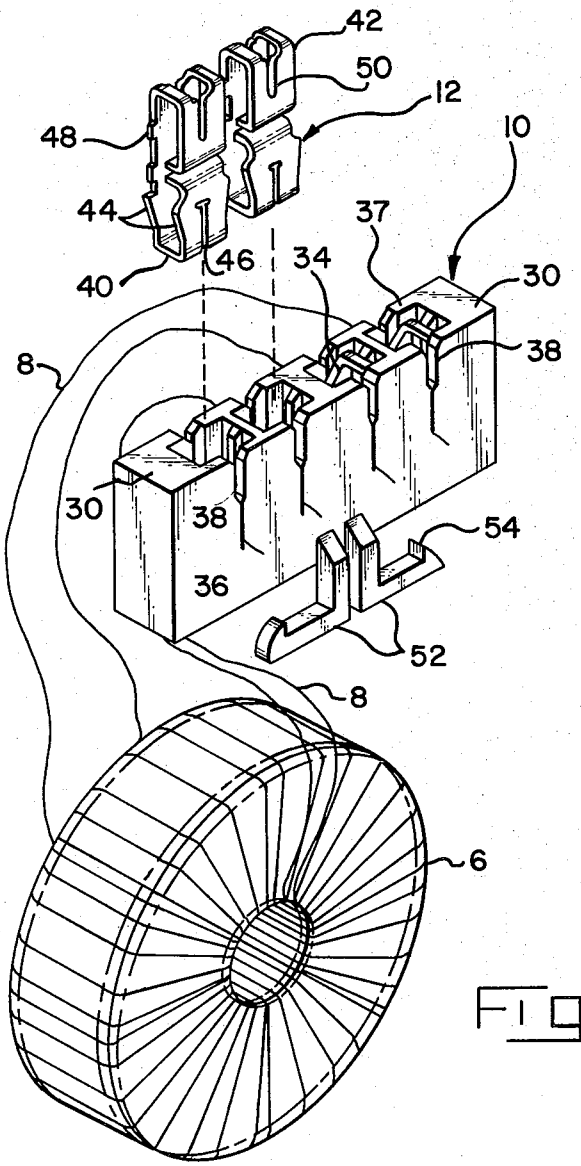
FIG. 2 is a perspective view of an individual toroidal coil and an associated terminal housing.

A coil cartridge 2 as shown in FIG. 1, comprises a cylindrical cartridge housing 4 of a suitable thermoplastic material having a stack of individual toroidal coils 6 coaxially contained in the housing with the coil wires 8 extending through an open seam in the housing to terminals contained in individual terminal housings 10 which are mounted on the external surface of the coil housing. The terminals 12 contained in the terminal housing 10 are in electrical contact with the coil wires 8 and are also adapted to receive and establish electrical contact with lead wires 14 thereby to connect the coil wires 8 to the lead wires. As shown in FIG. 2, each toroidal coil 6 is wound with two individual wires so that four wire ends extend from the individual coil 6 to the terminal housing 10 and are connected to four terminals 12. It should be mentioned that an individual coil 6 is connected in series with the two wires of a twisted pair of wires in a terminal cable.

Figure 3:
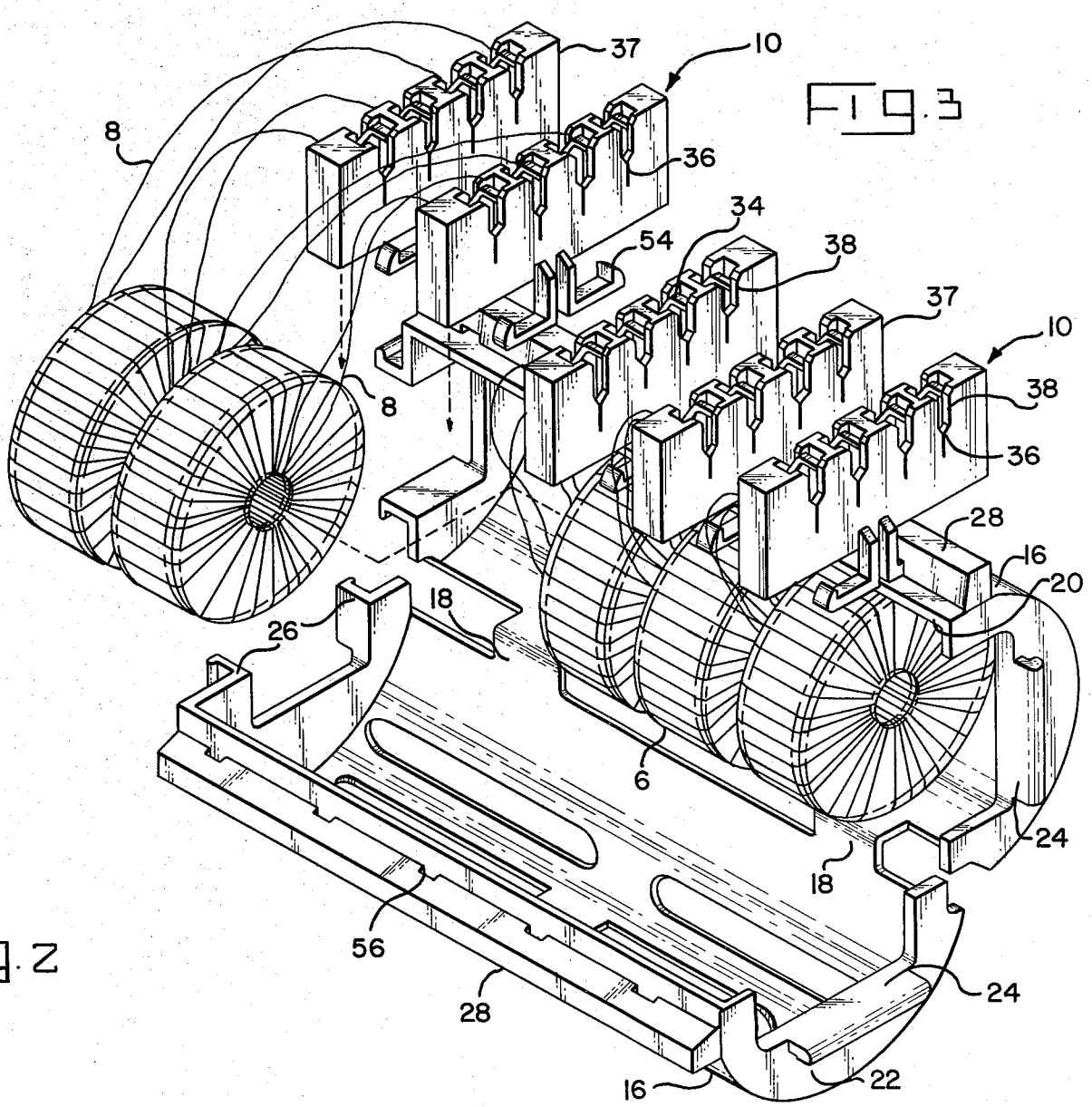
FIG. 3 is a perspective view showing the cartridge housing in its open condition and illustrating the assembly of the coils and the terminal housings to the cartridge housing.

A coil housing 4 comprises two semi-cylindrical housing parts 16 which are hinged together as shown at 18, so that they can be opened to receive the coils as shown in FIG. 3, and closed into surrounding relationship with a stack of coils, when the housing parts 16 are closed, their opposed edges 20 form an open seam through which the coil wires 8 extend to the terminal housings. The ends of the housing parts are partially closed as shown at 22, but are formed such that a central opening is provided when the housing parts are closed and flanges 24, 26 extend from two sides of each opening. This arrangement permits coil cartridges in the load coil assembly to be stacked against each other for stability. Each of the housing parts has an axially extending rib 28 on its surface extending beside the edges 20, these ribs providing one part of an interengaging means for holding the housing in a closed condition as will be described below.

The individual terminal housings 10 are also of molded thermoplastic material and are generally rectangular, having an upwardly facing, as viewed in the drawing, terminal-receiving surface 30, a downwardly facing lower surface 32, and terminal-receiving cavities 34 extending inwardly from the surface 30. Wire-receiving slots are provided in the laterally facing sidewalls 35, 37, the lower portion 36 of each slot being dimensioned to receive a relatively fine coil wire 8 while the upper portion 38 of each slot is dimensioned to receive a lead wire 14.

Each terminal 12 is of stamped and formed conductive sheet metal and is double ended in that it has a coil wire-receiving portion 40 on its lower end, as viewed in the drawing, and a lead wire-receiving portion 42 on its upper end. The coil wire-receiving portion comprises parallel platelike members 44 connected by spaced-apart connected straps and these platelike members have aligned coil wire-receiving slots 46 therein, dimensioned such that upon relative movement of a coil wire into a slot, electrical contact will be established with the coil wire. The lead wire-receiving portion 42 of each terminal similarly has parallel platelike sections 48 which are connected by connecting straps and which have aligned lead wire-receiving slots 50. The two portions of each terminal are integral with each other in that the rearward, as viewed in FIG. 3, platelike members 44, 48 are integral with each other. The individual terminals 12 are connected to the coil wires by simply placing the coil wires in the lower portions 36 of the slots in housing 10 and moving the slots downwardly and into the cavities 34 so that the coil wires are received in the slots.

Each housing 10 has integral L-shaped members extending from its sidewall 35 adjacent to the downwardly facing surface 32. The laterally extending arms of these members 52 having enlarged ends which define inwardly facing shoulders 54 for latching purposes in cooperation with openings 56 in the ribs 28 of the coil housing.

Coil cartridges in accordance with the invention, are produced by first providing a small amount of slack in the end of the coil wires 8, placing the ends of these wires in the lower portions 36 of the slots in the housings 10 and thereafter inserting terminals into each of the cavities 34. These operations may be carried out with the aid of an automatic, or semi-automatic insertion machine which trims the projecting ends of the coil wires when the terminals are inserted.

The cartridge is assembled by then stacking the required number of coils in an open coil housing as shown in FIG. 3, and inserting the righthand latch arms through the openings 56 in the rib 28 on the righthand portion 16 of the coil housing. Thereafter, the housing is closed into surrounding relationship with the coils and the remaining latch arm moves relatively through the opening 56 in the rib 28 on the other coil housing section. These latch arms thus maintain the coil housing in its closed condition and the coil wires will extend through the seam between the opposed edges 20 of the housing sections. The load coil assembly is then produced by stacking the required number of coil cartridges on top of each other and in a cluster which surrounds a cable and connecting the wires from the cable to the individual toroidal coils 6 by inserting the wires 14 into the wire-receiving slots in the housing.

Figure 5:
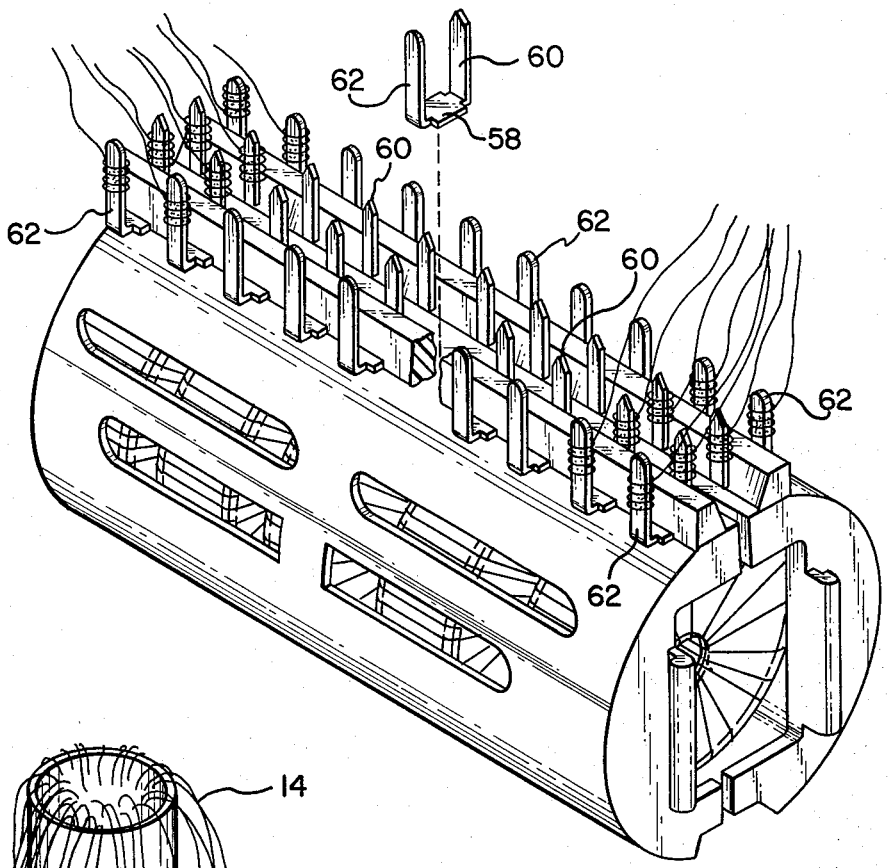
FIG. 5 (PRIOR ART)
FIG. 5 is a perspective view of a prior art coil cartridge.

The advantages of a coil cartridge in accordance with the invention will be apparent if a comparison is made with prior art coil cartridges, as shown in FIG. 5. The prior art coil housing is provided with U-shaped terminals 58 mounted in the previously identified ribs 28, two terminals being provided for each coil. Each terminal 58 has two upstanding arms 60,62 and the coil wires 8 are connected to the inner arms 60 by wrapping the coil wires around the inner arms and then passing the cartridge over a solder bath in a manner such that the arms 60 are immersed in the solder. The lead wires 14 are then connected to the arms 62 by any suitable method, such as by forming wrap-type connections as shown.

Figure 6:
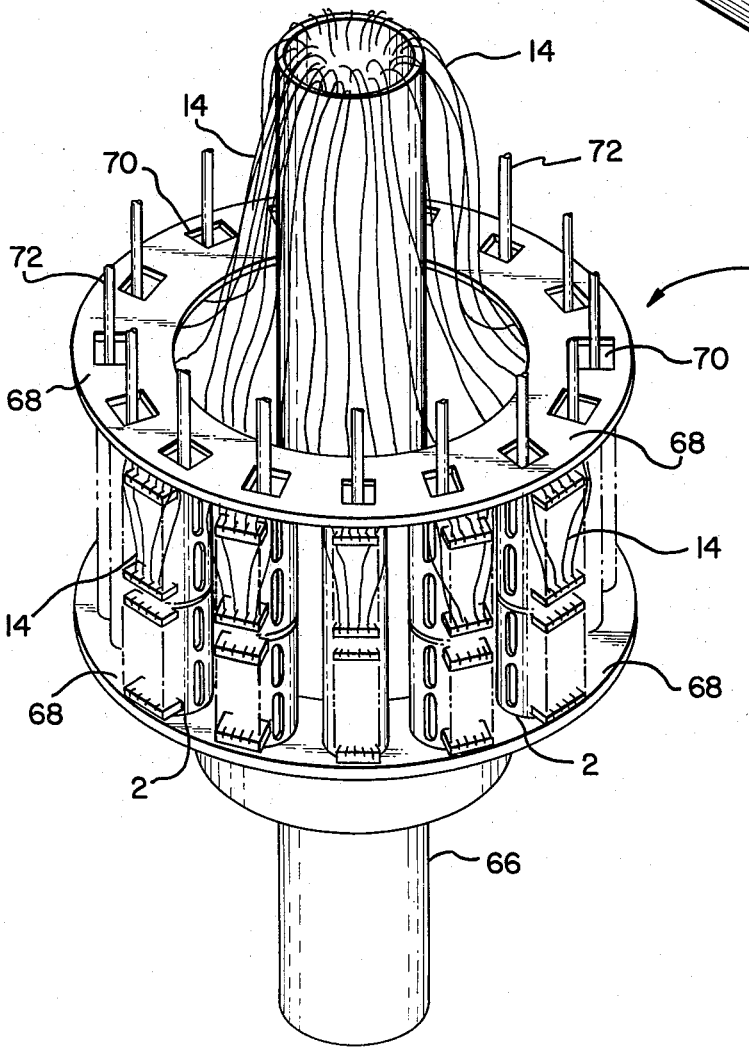
FIG. 6 is a perspective view of a partially assembled load coil.

FIG. 6 shows a partially assembled load coil assembly 64 in which the individual coils 6 are connected to the wires 14 in the cable 66 by means of coil cartridges 2 in accordance with the invention. Spaced-apart circular trays 68 are mounted concentrically on the cable and the coil cartridges are stacked on top of each other between adjacent trays. The trays have circular openings 70 therein which receive the blocking flanges 24, 26 of the cartridges and rods 72 extend through these openings and through the central openings in the coils to stabilize the assembly.

I claim:

1. A coil cartridge of the type comprising a cylindrical coil housing, a stack of coils within said coil housing arranged coaxially with the axis of said coil housing, the coil wires of said coils extending from said coils through an axially extending seam in said coil housing to terminal means on the surface of said coil housing, said coil wires being connected to said terminal means, said coil housing having a longitudinally extending hinge which is opposite to said seam to permit placement of said coils in said coil housing when said coil housing is open and to permit subsequent closing of said coil housing so that said coils are contained in said coil housing, said coil cartridge being characterized in that:

said coils have terminal housing means associated therewith, said terminal housing means having a plurality of terminal-receiving cavities extending into said housing from surface portions thereof, each of said cavities having a terminal therein, said terminal in each cavity having a coil wire-receiving slot extending into a first end thereof and a lead wire-receiving slot extending into a second end thereof, said first end of each terminal being at the inner end of its respective cavity, said second end of each terminal being adjacent to said surface portions of said terminal housing, said coil wires extending to, and being received in, said coil wire-receiving slots, said terminal housing means being originally separated from, and being assembled to, said coil housing, said terminal housing means and said coil housing means having interengaging means serving to maintain said coil housing in its closed condition whereby, said coil cartridge can be produced by first connecting the ends of said coil wires to terminals in said terminal housing means, thereafter placing said coils in said coil housing, closing said coil housing and engaging said interengaging means.

2. A cartridge as set forth in claim 1, said interengaging means comprising latch arm means and openings, said latch arm means extending through said openings.

3. A coil cartridge as set forth in claim 2, said latch arm means comprising pairs of latch arms extending in opposite directions from said terminal housing means, said openings being in said coil housing adjacent to said seam.

4. A coil cartridge as set forth in either of claims 1 or 3, said terminal housing means comprising a plurality, equal to the number of coils in said coil housing, of terminal housings, each of said terminal housings being associated with one of said coils.

5. A coil cartridge as set forth in claim 4, said terminal housings extending transversely of said seam.

6. A method of assembling a coil cartridge of the type comprising a cylindrical coil housing, a stack of coils within said coil housing arranged coaxially with the axis of said coil housing, the coil wires of said coils extending from said coils through an open seam in said coil housing to terminal means on the surface of said coil housing, said coil wires being connected to said terminal means, said coil housing having a longitudinally extending hinge to permit placement of said coils in said coil housing when said coil housing is open and to permit subsequent closing of said coil housing so that said coils are contained in said coil housing, said method comprising the steps of:

providing slack portions in said coil wires at the ends thereof and connecting said ends to terminals in terminal-housing means, stacking said coils in side-by-side relationship in an open coil housing, closing said open coil housing so that said coil housing surrounds said coils with said slack portions extending through said seam and said terminal housing means is located outside of said coil housing and, mounting said terminal housing means on the surface of said coil housing.

7. A method as set forth in claim 6 in which said ends of said coil wires of each coil are connected to terminals in a separate terminal housing so that each coil has an associated terminal housing.

8. A method as set forth in claim 7 includng the step of providing interengaging means on said terminal housings and said coil housing and engaging said interengaging means when said terminal housings are assembled to said coil housing.

* * * * *